United States Patent [19]

Ryhiner

[11] Patent Number: 5,016,304

[45] Date of Patent: May 21, 1991

[54] FLUIDIZED BED WITH MOISTURE REMOVING MEANS

[75] Inventor: Victor G. Ryhiner, Tilburg, Netherlands

[73] Assignee: Redactron B.V., Eersel, Netherlands

[21] Appl. No.: 313,540

[22] Filed: Feb. 22, 1989

[30] Foreign Application Priority Data

Mar. 29, 1988 [NL] Netherlands ..... 8800792

[51] Int. Cl.[5] ..... A61G 7/057

[52] U.S. Cl. ..... 5/453; 5/423; 5/469; 34/10; 34/57 A; 34/95

[58] Field of Search ..... 5/453, 449, 423, 469; 34/10, 57 A, 95

[56] References Cited

U.S. PATENT DOCUMENTS

| | | | |
|---|---|---|---|
| 2,998,817 | 9/1961 | Armstrong | 5/453 |
| 3,866,332 | 2/1975 | Hertz | 34/57 |
| 4,564,965 | 1/1986 | Goodwin | 5/453 |
| 4,694,521 | 9/1987 | Tominaga | 5/453 |
| 4,723,328 | 2/1988 | Kato | 5/453 |
| 4,835,802 | 6/1989 | Purcey et al. | 5/453 |

FOREIGN PATENT DOCUMENTS

| | | | |
|---|---|---|---|
| 0194868 | 4/1986 | European Pat. Off. . | |
| 458373 | 10/1913 | France . | |
| 1516528 | 3/1968 | France . | |
| 2555438 | 5/1985 | France . | |
| 122250 | 12/1966 | Netherlands . | |
| 645042 | 10/1950 | United Kingdom | 5/421 |

OTHER PUBLICATIONS

"Engineering Helps . . . " An Article on page 16 of Product Engineering, vol. 40, No. 11, 6/2/69.

"Clinitron" A Trade Publication of S.S.I. Inc. of 4349 Corporate RO. , Charleston Heights, S.C. 29405, 10/87 or Earlier.

*Primary Examiner*—Alexander Grosz

*Attorney, Agent, or Firm*—Watson, Cole, Grindle & Watson

[57] ABSTRACT

A method and device in particular a therapeutic device for abstracting moisture and fluid from one or more bodies such as bedridden patients, whereby use is made of a bed of moisture and fluid absorbing beads, wherein said beads in the bed are being fluidized by an air supply and conditioning system; air supplied in the fluidization bed having a low relative degree of humidity and suitable temperature which increases the regenerative action of the fluidization bed, necessary for abstracting moisture and fluid from said beads and said body.

9 Claims, 2 Drawing Sheets

FLUIDIZED BED WITH MOISTURE REMOVING MEANS

BACKGROUND OF THE INVENTION

The invention relates to a method and device for abstracting moisture and fluid from one or more bodies using a bed of moisture and fluid-absorbing beads.

In various processes and therapeutic treatments fluid is abstracted from bodies, that is, objects such as industrial or agricultural products and living creatures such as humans and animals. A known method is to place the body partly or completely in a bed of absorbent beads, which beads subsequently abstract the fluid from the body in a more or less uniform manner.

The object of the invention is to improve the above-mentioned method and device by the provision of an air supply system for the fluidization of the beads in the bed. A better enclosure of the body by the absorbent beads is thereby achieved, whereby the air flow not only brings about a constant change in contact between beads and body but at the same time regenerates the beads by abstracting moisture and fluid from them.

In a preferred embodiment an air drying device is arranged in the air supply system, ensuring that the air supplied to the fluidization bed has a low relative degree of humidity, which increases the regenerative action of the fluidization bed.

The invention relates further to a therapeutic device for the conditioning of bedridden patients, which device contains an air-permeable lying surface to carry the patient, an air chamber arranged thereunder with the bead-form moisture and fluid-abstracting filling, an air supply system leading into the chamber and provided with a treatment device for obtaining the required temperature at a low relative humidity.

Such devices are normally used with seriously ill patients such as coronary, surgical, intensive care, neurosurgical, skin transplant and burn-wounds patients and the like, who have not only to be painlessly supported but also as uniformly as possible and with a predetermined lying surface temperature. This lying surface temperature can be significantly lower than the ambient temperature. The lying surface must also be suitable for allowing body fluids to pass through and be drawn downward, whereby the problem arises that these fluids have to be removed in a hygienic manner and without interfering with the fluidization of the beads. Because of the danger of infection it is not possible to carry away these fluids outside the area in which the device is installed.

The invention further proposes a device which is distinguished in that the air chamber has a fluid discharge opening which leads to a heating member for evaporating the discharged fluids.

As a result of this step a discharge does not have to be arranged, which maintains the antiseptic conditioning in the nursing area. The formation of clusters of beads through excessive moisture and fluid absorption is avoided, which cluster-formation would lead to a hardening of the lying surface. The humidity of the surrounding air thereby remains at a desired level, sufficient to rapidly humidify the relatively dry air exuding from the lying surface, which makes the ambient air more pleasant for the patient.

Where the air treatment device is provided with a cooling circuit, consisting of a compressor, evaporating means and condenser, it is recommended according to the invention to embody the evaporating means with a condensation collector communicating with the air chamber and in which the heating member is arranged. In this way both the moisture and fluid exuding from the processing air and the body fluid can be evaporated simultaneously. In a particularly simple embodiment the heating member is a heat exchanger arranged in the connecting line from the compressor to the condenser. In this way the medium (for example freon) which serves to cool and dry the processing air can be used at the same time for the heating member in order to evaporate the released fluid.

The above mentioned and other characteristics are further elucidated in the figure description of an embodiment given below.

DETAILED DESCRIPTION OF THE PREFERRED EMBODIMENTS

Figure 1:
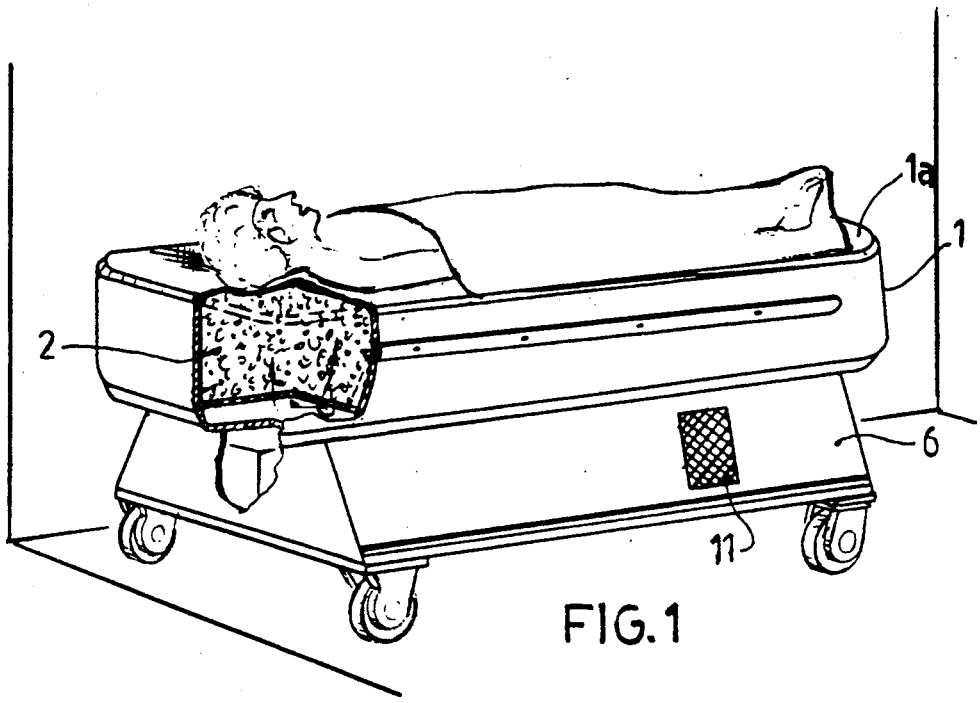
FIG. 1 is a perspective front view of a conditioning device according to the invention, whereby the peripheral wall is partly broken away.

The device shown in the figures includes a bed means 1 that provides an air-permeable upper lying surface 1*a* and a porous floor in the form of a partition 1*b*. The bed means defines a chamber 2 therein. The material of surface 1*a* is for example fine-woven Polycon sheeting with a permeability of 50 $\mu$. The beads can have diameter of between 70 and 140 microns. The chamber 2 is filled with a material in bead form, e.g., grains of Natron lime glass which have an antiseptic action. Located below the underside of the bed is a distribution chamber (plenum) 3 having a floor 3*a*. A duct 4 is connected to the floor 3*a*. The porous partition 1*b* enables a uniform supply of air to flow upwardly into the chamber 2 to uniformly fluidize the filling in the chamber 2. The patient therefore lies on a fluidization bed which completely adapts itself to the shape of the body, whereby uniform support of the patient is achieved.

It is thereby of importance to choose the air temperature of the fluidization bed in such a way as is most comfortable for the patient. Using the following steps the patient is prevented from getting bedsores.

The fluidization air which is supplied through the duct 4 is pre-treated in an air supply system which is designated in its entirety with 5. This system is arranged in the lower part of cabinet 6 of the device. The air treatment system consists of an evaporating means 7 which is arranged in an air treatment chamber 8, to which is connected the duct line 4 and also the air inlet pipe 9. The air inlet pipe 9 is fed via an air pump 10 with ambient air, indicated by the arrow $P_1$, which is drawn in from the area in which the device system is installed via an opening 11 in the lower cabinet part.

The air pump 10 is controlled by a pressure sensor 15 such that a constant fluidization pressure is maintained, irrespective of the body weight of the patient.

The evaporating means forms a part of a cooling circuit which consists further of a compressor 12 and a condenser 13. The condenser 13 is provided with a fan 14 to carry away heat. The compressor 12 regulates transportation of a coolant, e.g. freon, via the connecting lines in the direction of the arrow $P_2$ along the previously mentioned evaporating means 7.

It should be noted that in the compartment 8' situated under the evaporating means 7 a heating coil 16 is arranged which is located in the connecting line between compressor 12 and condenser 13.

Finally, the air which is carried into the air inlet pipe 9 via the pump 10 can be pre-heated by means of an electric heating member 17.

The device described above operates as follows.

When the fluidization air is drawn in via opening 11, pump 10 and air inlet pipe 9, the air can, if required, be preheated by the heating member 17 before it arrives in the air treatment chamber 8. As a result of cooling, a drying of the air takes place in chamber 8 such that dry air arrives in the fluidization chamber 2 via the duct 4 and the distribution space 3 and can return to the surrounding atmosphere via the lying surface 1*a*. The relative humidity and temperature of the air is such that it is therapeutically the most advantageous for the patient. When moisture and fluid is abstracted from the air via the air treatment chamber 8, vapor droplets will form on the evaporating means 7, which are collected in the lower cabinet part 8'. Arranged therein is the heating member 16 forming a part of the freon circuit in which, after the cooling of the air in the air treatment chamber 8, the freon is heated via the compressor 12 and led back to the heating member 16, whereby it will evaporate the precipitation. The freon is subsequently further condensed in the condenser 13. The suggested disposition has the further advantage that all the body fluid that returns into the distribution chamber 3 via the lying surface 1*a* and the fluidization bed 2 is also carried away via the duct 4 into the compartment 8', which results also in the removal of excess body fluid through evaporation. The humid air from the compartment 8' is carried into the free space around the device which contributes to a relatively more humid ambient air than the dry processing air for the fluidization chamber 2.

In an efficient therapeutic treatment the temperature of the fluidization bed can be 26° C., which is kept constant at an ambient temperature that may vary between 20°-35° C. at a relative humidity of 85%. The pressure in the air supply system is maintained at 420 mm water column, irrespective of the ambient pressure and the weight of the patient. The air displacement is preferably 52.9 $m^3$, whereby the relative ambient humidity may vary between 35-85%. The maximum relative humidity of the fluidization air is 72%.

Natron lime glass is used as the bead filling, which, with the values given above, acquires a viscosity of one and a half times that of water. This gives a settling of the patient into the air bed of circa 10 cm, which ensures the required "floating" therapeutic treatment.

Figure 3:
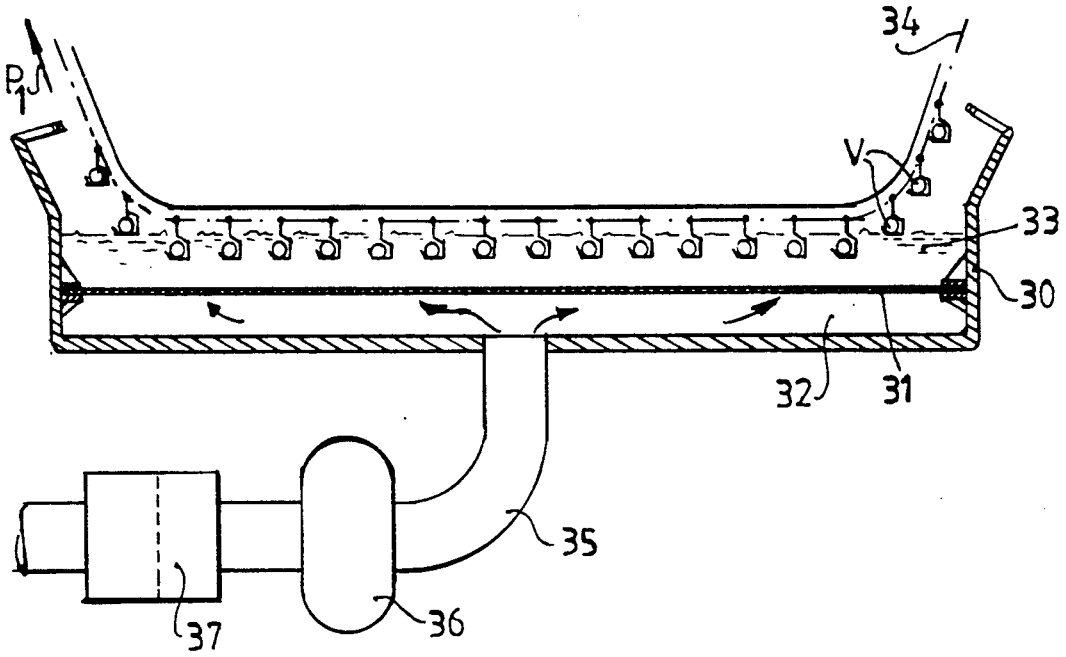
FIG. 3 is a schematic, vertical section of a more general application of the device according to the invention.

FIG. 3 shows a more general application possibility of the dried fluidization bed according to the invention. In this diagrammatic representation a container 30 is arranged which is provided with an air permeable partition wall 31 in order to form an air distribution chamber 32 beneath partition wall 31. Arranged above the wall 31 is a filling of material 33 in bead form of a thickness such that objects V can be completely immersed in the layer of beads. The objects V are supplied and removed on a hanging conveyor 34 in the direction of the arrow $P_1$.

Figure 2:
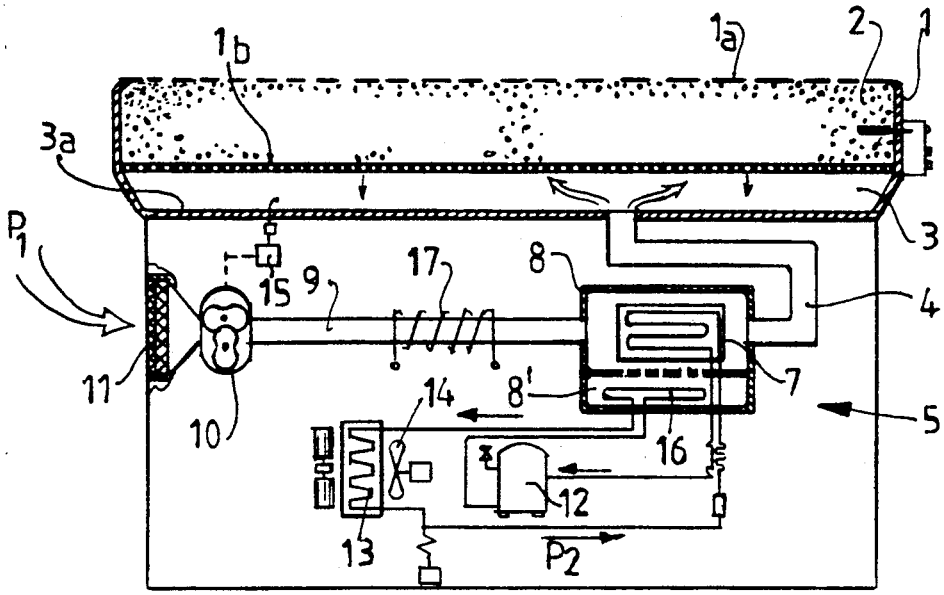
FIG. 2 shows a vertical section through the device according to FIG. 1 with a schematically indicated air treatment system in the lower part of the cabinet.

The air distribution chamber 32 is fed by an air supply system 35 by means of a fan or blower device 36 whereby the air supply system 35 can, if required, be provided with an air drying device 37. The air drying device 37 can take the form of the embodiment described above according to FIG. 2. In this application it is not however necessary to evaporate any downward falling fluid with a heating member 16 in accordance with this embodiment.

In the air distribution chamber 32 the bead filling 33 is fluidized above the partition wall 31 as a result of which the objects, which have to be dried, are easily let into this bed, can be kept in the bed for a determined length of time depending on the transporting speed $P_1$ and subsequently removed in a dry state. Because of the turbulent nature of the fluidization bed the moistened beads in the filling 33 are constantly removed from the path of the objects, dried and then again brought into contact with the objects.

The invention is not limited to the embodiments described above, whereby it can be noted that the heating member 16 for example can also take an electrical form for the achieving of the required evaporating effect. Any other heating source is of course possible here. It is further possible to fit the heating member 16 in a collecting box separate from the air chamber 8, which can communicate with the distribution area 3 and the fluidization space 2.

What is claimed is:

1. A device for supporting a moisture-containing body and for accepting moisture emanating from said body, said device comprising:

bed means defining an air-permeable upper surface on which a moisture-emitting body can be placed and a porous floor, said bed means providing a chamber between said upper surface and said porous floor, a bed of beads contained in said chamber, said bed of beads being capable of absorbing moisture flowing into said chamber from said body through said air-permeable upper surface, plenum means below said bed means for supplying a uniform flow of air upwardly through said porous floor of said bed means and into said chamber to uniformly fluidize said bed of beads and for accepting moisture flowing downwardly from said bed of beads through said porous floor, said plenum means defining a floor, and an air-supply system connected to said floor of said plenum means for supplying treatment air to said plenum means at a controlled temperature and relative humidity and for draining moisture out of said plenum means, said air-supply system including an air treatment chamber in which air from the environment around said device is cooled and water vapor therein removed as moisture, thereby providing said treatment air, and a first heating means for evaporating said moisture into water vapor for return to said environment.

2. A device according to claim 1, wherein said air treatment chamber includes an evaporating means and wherein said first heating means is positioned below said evaporating means.

3. A device according to claim 1, wherein said air treatment chamber includes a permeable partition which divides said air treatment chamber into an upper compartment and a lower compartment, and wherein said first heating means is located in said lower compartment.

4. A device according to claim 3, wherein said air-supply means includes an interconnected compressor, condenser and evaporating means, and wherein said evaporating means is located in said upper compartment.

5. A device according to claim 4, wherein said first heating means comprises a heat exchanger located in a line connecting said evaporating means with said condenser.

6. A device according to claim 4, including an air inlet pipe for supplying air to said air treatment chamber, and including a second heating means for heating air flowing through said air inlet pipe.

7. A device according to claim 6, including a fan located connected to said air inlet pipe.

8. A device according to claim 1, wherein said bed of beads comprises beads having diameters of between 70 and 140 microns.

9. A device according to claim 1, wherein said bed of beads comprises beads of Natron lime glass.

* * * * *